US006305982B1

(12) United States Patent
Wu

(10) Patent No.: US 6,305,982 B1
(45) Date of Patent: Oct. 23, 2001

(54) ELECTRICAL CONNECTOR ASSEMBLY

(75) Inventor: Ming-Chuan Wu, Taipei Hsien (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/135,218

(22) Filed: Aug. 17, 1998

(30) Foreign Application Priority Data

Aug. 16, 1997 (TW) ..... 86214199

(51) Int. Cl.[7] ..... H01R 19/00
(52) U.S. Cl. ..... 439/607
(58) Field of Search ..... 439/607, 78, 83, 439/186, 637, 95, 108, 636, 629, 632

(56) References Cited

U.S. PATENT DOCUMENTS 5,697,799 * 12/1997 Consoli et al. ..... 439/181

* cited by examiner

*Primary Examiner*—Brian Sircus
*Assistant Examiner*—Javaid Nasri

(57) ABSTRACT

A board-to-board electrical connector assembly consists of a plug connector connected to a daughter board and a receptacle connector connected to a mother board. The receptacle connector has a first housing with a top face connected to the mother board and a bottom face connected to the plug connector, a pair of metal shields mounted to a front and rear face of the first housing, respectively, and a number of contacts fixedly received in contact passageways of the first housing. Each metal shield is integrally formed with two lateral sections each including an upper solder pad soldered to a grounding circuit of the mother board, and a leg covering a corresponding lateral wall of the first housing and defining an engaging foot, and a body portion between the two lateral sections. The body portion is formed with a bent line between and parallel to an upper and lower edge of the body portion. The plug connector has a second housing, a number of contacts fixedly received in contact passageways of the second housing and two second solder pads fixed to lateral ends of the second housing. The second solder pads are soldered to a grounding circuit of the daughter board and connect with the engaging feet of the shields. The bent line causes the lower edge of the shield to extend toward the second housing so that beads formed on the lower edge can positively engage with grounding contacts of the contacts of the plug connector.

18 Claims, 7 Drawing Sheets

ELECTRICAL CONNECTOR ASSEMBLY

BACKGROUND OF THE INVENTION

1. Field of The Invention

The present invention relates to an electrical connector assembly, and particularly to an electrical connector assembly for directly connecting two printed circuit boards together which has an improved electromagnetic inferference/radio frequency interference (EMI/RFI) protection.

2. The Prior Art

A board-to-board connector assembly is used for directly connecting a daughter board to a mother board, without the necessity of using an auxiliary device such as a cable.

FIGS. 6 and 7 show a conventional board-to-board connector assembly including a receptacle connector 1 and a plug connector 2. The receptacle connector 1 consists of a dielectric housing 11, a number of contacts 14 (only one shown), a pair of shields 12 and a pair of solder pads 13. The housing 11 is formed to have a generally rectangular configuration with a bottom face 18 for proximity to the plug connector 2, a top face 19 for proximity to a mother board (not shown), a channel 111 exposed to the bottom face 18, a number of contact passageways 112 beside the channel 111, a pair of solder pad mounting ears 15 projecting laterally near the top face 19 and each defining a solder pad receiving recess 151 fixedly receiving a corresponding solder pad 13, and a number of shield mounting blocks 113 on a front and rear side (not labeled) of the housing 11 near the bottom face 18. Each shield 12 is configured to have a number of alternating engaging tabs 121 and lugs 122 near a lower edge thereof. Each engaging tab 121 is interferentially engaged between two corresponding shield mounting blocks 113. Each lug 122 has a bead 123 projecting toward the housing 11. Each shield 12 further forms a number of fingers 124 at an upper edge thereof projecting into corresponding contact passageways 112 to connect with corresponding contacts 14 connecting with a grounding circuit of the mother board. The solder pads 13 are soldered to the mother board to enhance the fastening of the receptacle connector 1 to the mother board.

The plug connector 2 consists of an elongate dielectric housing 21, two solder pads 24, a number of contacts 22 and a number of auxiliary contacts 214. The housing 21 is formed with an outer wall 210 defining a number of auxiliary contact passageways 213, a central ridge 211 located within the outer wall 210, and two solder pad mounting ears 23 at lateral ends of the housing 21 fixedly receiving the two solder pads 24, respectively. The central ridge 211 defines two rows of contact passageways 212 in a front and rear face (not labeled) thereof, respectively. The contacts 22 are fixedly received in the contact passageways 212, and the auxiliary contacts 214 are fixedly received in the auxiliary contact passageways 213. Furthermore, each auxiliary contact 214 has a portion contacting a corresponding contact 22 connecting with a grounding circuit of a daughter board (not shown). The solder pads 24 are soldered to the daughter board to enhance the fastening of the plug connector 2 to the daughter board.

When the receptacle and plug connectors 1, 2 are assembled, the central ridge 211 extends into the channel 111 so that the contacts 22, 14 of the plug and receptacle connectors 1, 2 are electrically connected together. The beads 123 on the lugs 122 of the shields 12 of the receptacle connector 1 extend into the corresponding auxiliary contact passageways 213 to contact with the corresponding auxiliary contacts 214 of the plug connector 2, whereby the connector assembly can be protected from EMI/RFI by the shields 12.

However, such a conventional board-to-board connector assembly does not shield two lateral ends of the housing 11 of the receptacle connector 1, which results in incomplete protection of the assembly from EMI/RFI. Furthermore, the connector assembly requires many components which increases manufacturing costs. Furthermore, the grounding circuit of the daughter board is only connected to the grounding circuit of the mother board via the connection between the auxiliary contacts 214 and the beads 123. Such a connection is inadequate to ensure a reliable transmission of noise received by the plug connector 2 to the grounding circuit of the mother board. Finally, as each shield 12 has an excessively large surface/thickness ratio, it cannot have a rigidity sufficient to ensure the flatness thereof. The lower edge of each shield 12 may deflect away from the housing 11 when it is mounted thereto, which causes the beads 123 to improperly contact (or even disengage from) the auxiliary contacts 214 of the plug connector 2, thereby unfavorably affecting the shielding effectiveness designed to be achieved by the shields 12.

Hence, an improved board-to-board connector assembly is needed to eliminate the above mentioned defects of the conventional board-to-board connector assembly.

SUMMARY OF THE INVENTION

Accordingly, an objective of the present invention is to provide a board-to-board connector assembly which can be completely protected from EMI/RFI.

Another objective of the present invention is to provide a board-to-board connector assembly requiring fewer components, resulting in a lower manufacturing cost.

A further objective of the present invention is to provide a board-to-board connector assembly which reliably transmits noise received by the plug connector to the grounding circuit of the mother board.

Still a further objective of the present invention is to provide a board-to-board connector assembly which has metal shields with lower portions defining beads bent toward a plug connector of the assembly, thereby ensuring a positive engagement between the beads and auxiliary contacts of the plug connector.

To fulfill the above mentioned objectives, according to one embodiment of the present invention, a board-to-board connector assembly includes a receptacle connector connected to a mother board and a plug connector connected to a daughter board. The receptacle connector comprises a first dielectric rectangular housing having a top face connected to the mother board, a bottom face opposite the top face, a front face, a rear face and two lateral walls between the bottom and top faces, a channel in the bottom face and a number of first contact passageways beside the channel and defined from the bottom face to the top face. A number of first contacts are fixedly received in the first contact passageways each having a tail portion soldered to the mother board. A pair of shields are fixed to the front and rear faces of the first housing. Each shield is integrally formed with a pair of lateral sections each having an upper solder pad soldered to a grounding circuit of the mother board and a leg covering a corresponding lateral wall of the first housing. Each shield further forms a number of lugs on a lower edge thereof, a number of fingers on an upper edge thereof, and a bent line formed between and parallel to the upper and lower edges to cause the lower edge of the shield to extend toward the first housing. Each lug forms a bead projecting toward the first housing. The fingers extend into some of the first contact passageways to connect with some of the first contacts which are soldered to the grounding circuit of the mother board.

The plug connector comprises a second rectangular housing defining an outer wall and a ridge within the outer wall. The ridge extends into the channel of the first housing and defines a number of second contact passageways in a front and rear face thereof. A number of second contacts are received in the second contact passageways and electrically connect with the corresponding first contacts. Each second contact has a tail portion soldered to the daughter board. A number of auxiliary contacts are fixedly received in auxiliary contact passageways defined in the outer wall of the second housing and electrically connect with some of the second contacts which are soldered to a grounding circuit of the daughter board. A pair of solder pads are fixed to lateral ends of the second housing and soldered to the daughter board for electrically connecting with the grounding circuit thereof and the legs of the shields.

DETAILED DESCRIPTION OF THE PREFERRED EMBODIMENT

Figure 1:
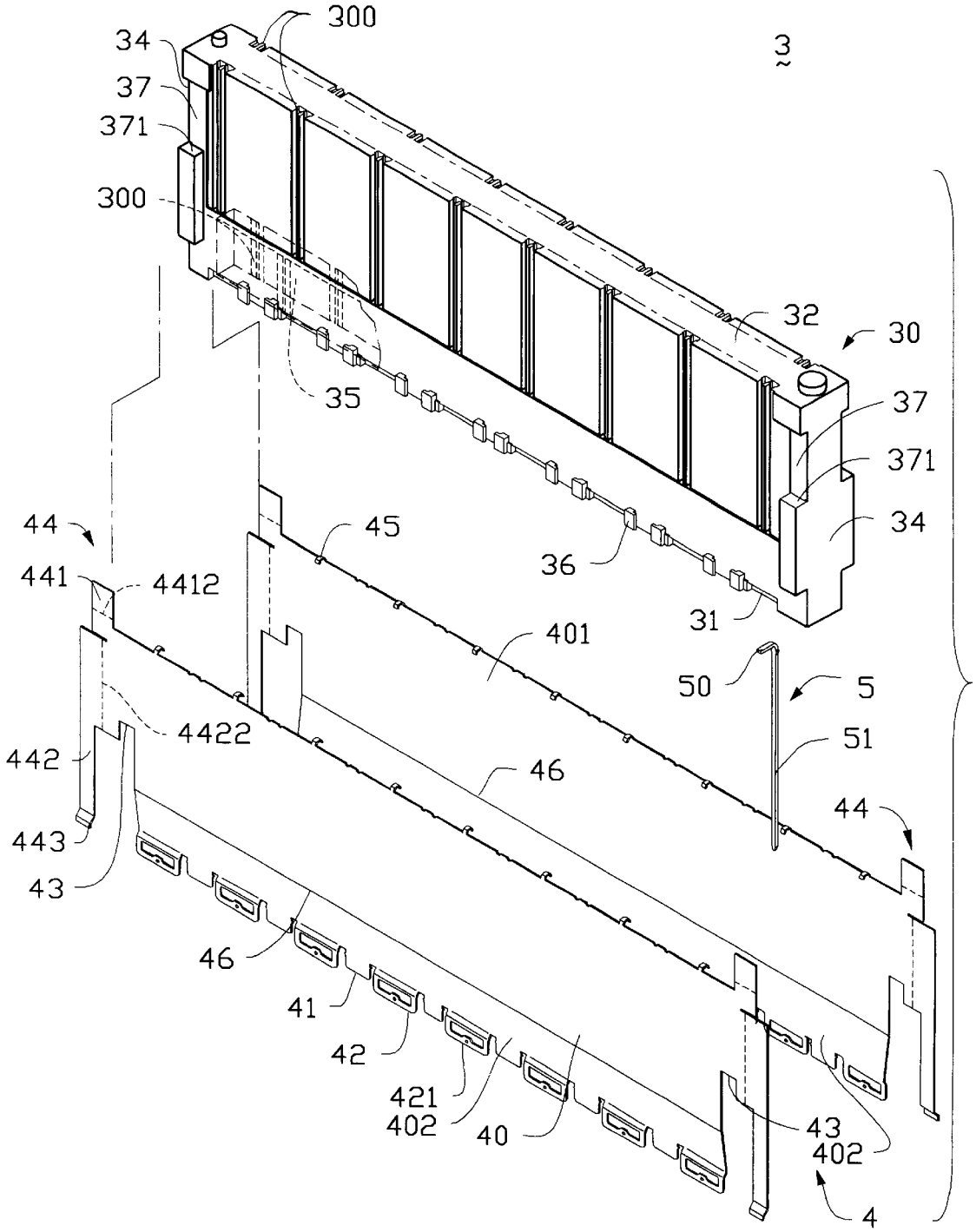
FIG. 1 is a perspective, exploded view of a receptacle connector in accordance with the present invention.

Reference will now be made in detail to the preferred embodiment of the present invention. to FIGS. 1 to 3, a board-to-board electrical connector assembly in accordance with the present invention consists of a receptacle connector 3 and a plug connector 6.

The receptacle connector 3 consists of a dielectric housing 30, a number of contacts 5 (only one shown) and a pair of EMI/RFI shields 4.

The housing 30 has a rectangular configuration with a bottom face 31 for proximity to the plug connector 6, a top face 32 for proximity to a mother board (not shown), a channel 35 exposed to the bottom face 31, a number contact passageways 300 beside the channel 35 and defined from the bottom face 31 to the top face 32, and two lateral walls 34. Each lateral wall 34 defines a depression 37 in a front and rear face thereof to form a seat 371 therebelow. A number of mounting blocks 36 are formed on a front and rear face (not labeled) of the housing 30 near the bottom face 31.

Each contact 5 includes a tail portion 50 for being soldered to the mother board and a contact portion 51 for electrically connecting with the plug connector 6.

Each shield 4 is formed by stamping a metal sheet to have a rectangular body portion 40 having an upper edge formed with a number of fingers 45 bent toward the housing 30, and a lower edge formed with a number of alternating engaging tabs 41 and lugs 42. Each lug 42 has a bead 421 protruding toward the housing 30. Two lateral sections 44 are formed connecting with an upper part of two lateral ends of the body portion 40. Each lateral section 44 includes an upper solder pad 441 and a lateral leg 442. Each lateral leg 442 forms an engaging foot 443 at a bottom thereof. Two recesses 43 are defined between the lateral sections 44 and the body portion 40 of each of the shields 4. A straight bent line 46 is formed on the body portion 40 between and parallel to the upper and lower edges thereof to divide the body portion into an upper part 401 and a lower part 402 extending in different orientations. The bent line 46 is formed to ensure that the beads 421 on the lugs 42 can positively engage with auxiliary contacts of the plug connector 6, as explained in detail below.

Figure 2:
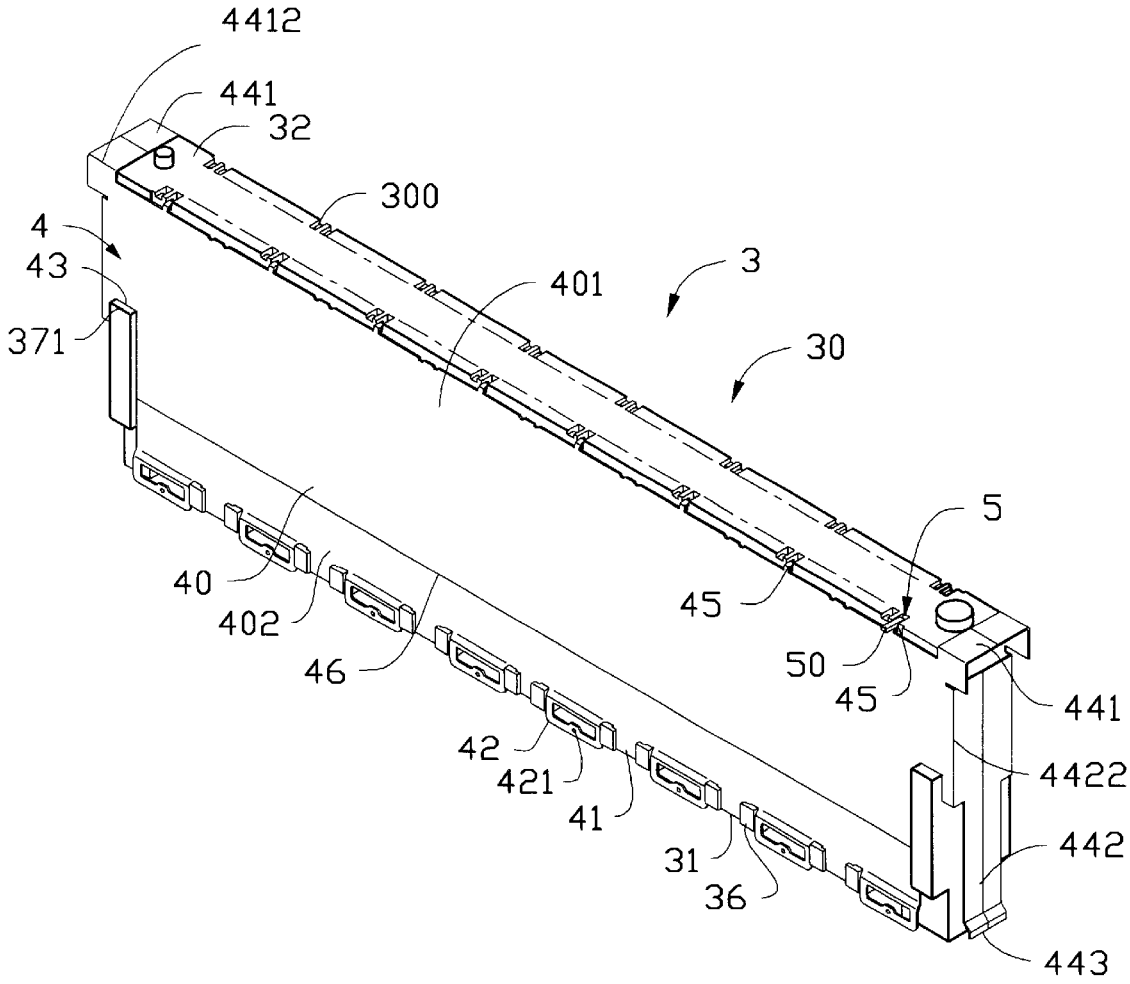
FIG. 2 is a perspective, assembled view of the receptacle connector of FIG. 1.

To assemble the receptacle connector 3, particularly referring to FIG. 2, the contacts 5 are fixedly received in the housing 30 by inserting the contact portions 51 thereof in the corresponding contact passageways 300 to reach a position where the tail portions 50 thereof are substantially flush with the top face 32. The shields 4 are then respectively mounted to the front and rear faces of the housing 30 by interferentially fitting each engaging tab 41 between two corresponding mounting blocks 36 whereby the recesses 43 fittingly receive the seats 371 of the lateral walls 34 of the housing 30 and the fingers 45 extend into corresponding contact passageways 300 to electrically connect with corresponding contacts 5 to be soldered to a grounding circuit of the mother board on which the receptacle connector 3 is mounted. When the shields 4 are mounted to the housing 30, the upper part 401 of each body portion 40 of each shield 4 extends parallel to the housing 30 and the lower part 402 thereof extends toward the housing 30. Afterward, the solder pads 441 are bent along dotted lines 4412 (FIG. 1) to be perpendicular to the body portions 40 of the shields 4 and flush with and beside the top face 32 of the housing 30. The legs 442 are bent along dotted lines 4422 (FIG. 1) to be perpendicular to the body portions 40 and cover the lateral walls 34 of the housing 30, whereby the assembly of the receptacle connector 3 is complete. The bent solder pads 441 are soldered to the mother board to enhance the fastening of the receptacle connector 3 thereto and to electrically connect with the grounding circuit of the mother board. Each engaging foot 443 projects from a corresponding leg 442 in a direction away from a corresponding side wall 34 of the housing 30.

Figure 3:
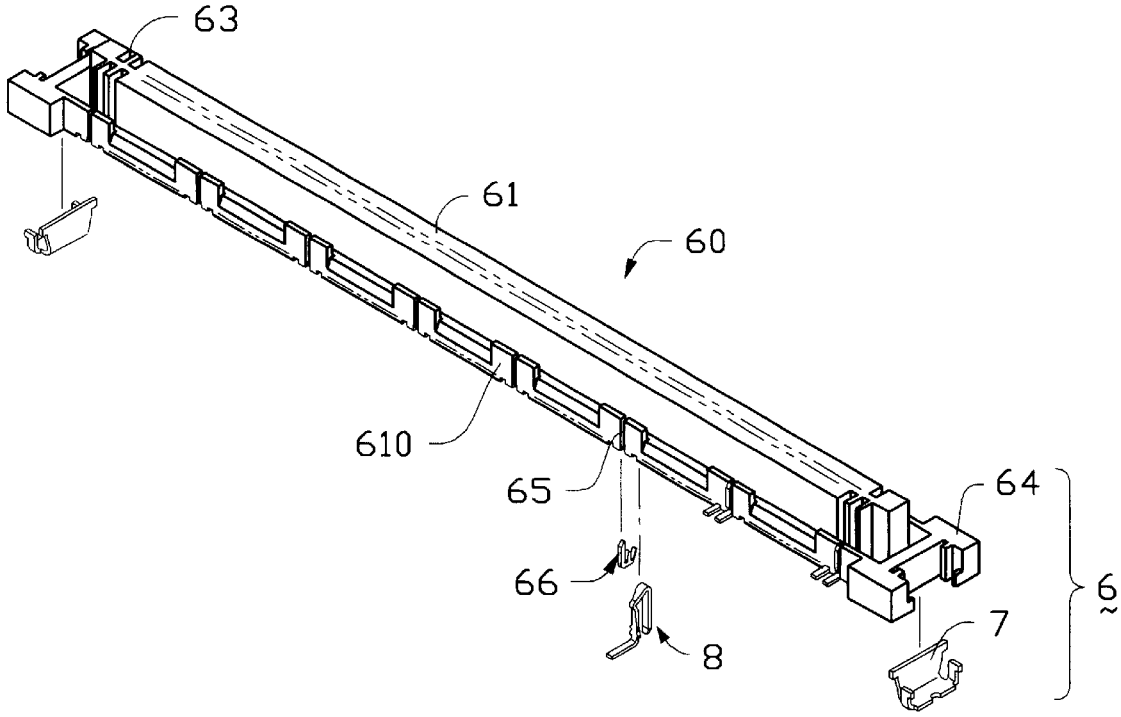
FIG. 3 is a perspective, exploded view of a plug connector in accordance with the present invention.
Figure 6:
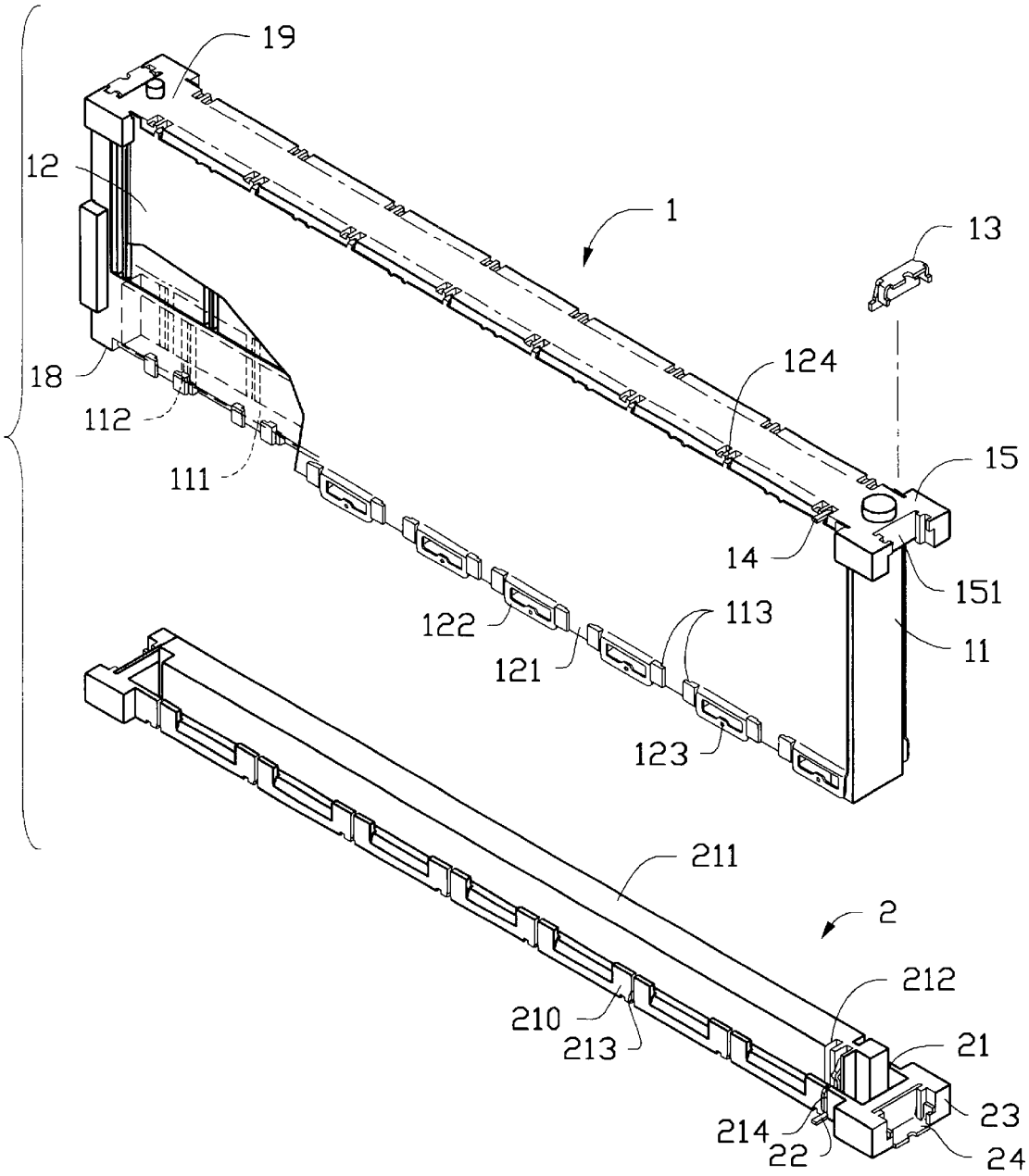
FIG.6 (PRIOR ART)
FIG. 6 is a perspective, exploded view of a conventional board-to-board connector assembly.
Figure 7:
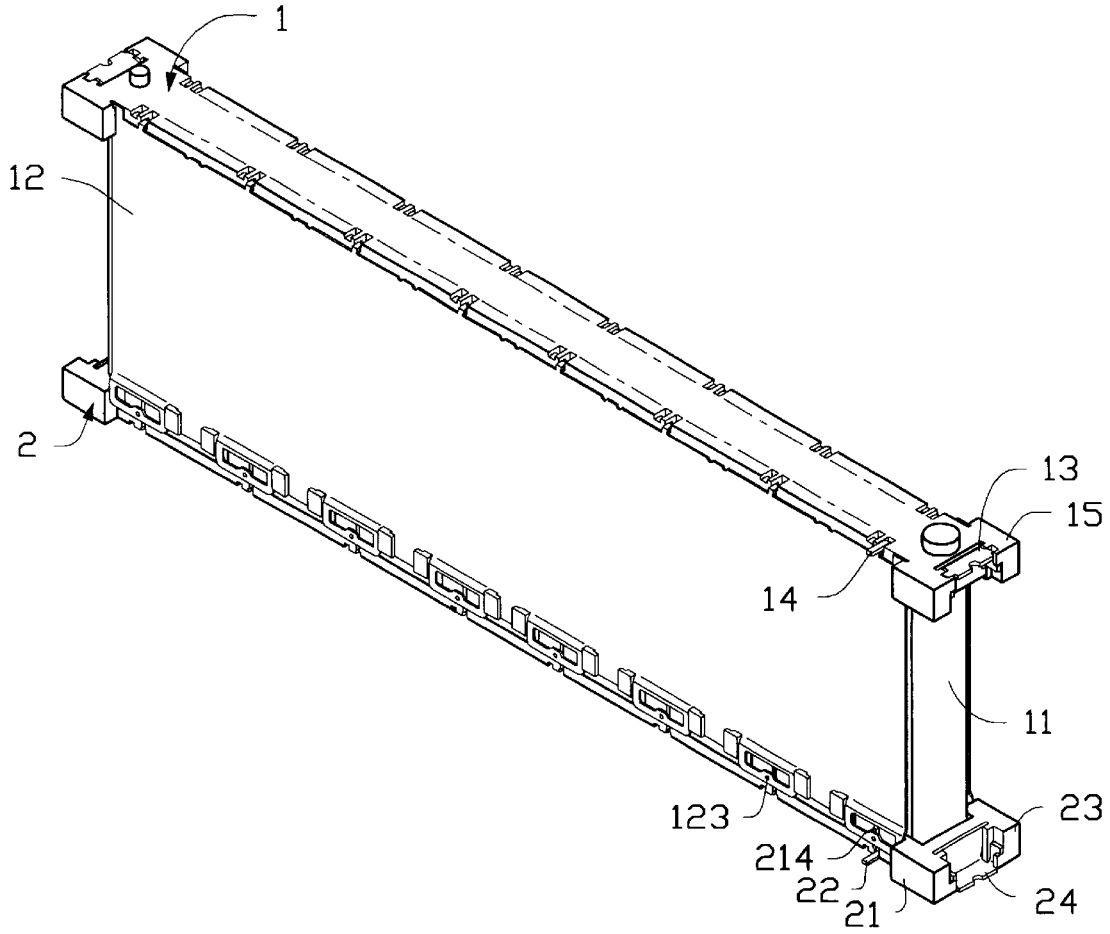
FIG.7 (PRIOR ART)
FIG. 7 is a perspective, assembled view of the board-to-board connector assembly of FIG. 6.

Particularly referring to FIG. 3, the plug connector 6 in accordance with the present invention has a structure substantially the same as the conventional plug connector 2 of FIG. 6.

The plug connector 6 consists of an elongate dielectric housing 60, two solder pads 7, a number of contacts 8 and a number of auxiliary contacts 66. The housing 60 is formed with an outer wall 610 defining a number of auxiliary contact passageways 65, a central ridge 61 located within the outer wall 610, and two solder pad mounting ears 64 at lateral ends of the housing 60 fixedly receiving the two solder pads 7, respectively. The central ridge 61 defines two rows of contact passageways 63 in a front and rear face (not labeled) thereof, respectively, for fixedly receiving the contacts 8 therein. The auxiliary contacts 66 are fixedly received in the auxiliary contact passageways 65 and each have a portion contacting with a corresponding contact 8 connected with a grounding circuit of a daughter board (not shown) on which the plug connector 6 is mounted. The solder pads 7 are soldered to the daughter board to enhance the fastening of the plug connector 6 to the daughter board and to electrically connect with the grounding circuit of the daughter board.

Figure 4:
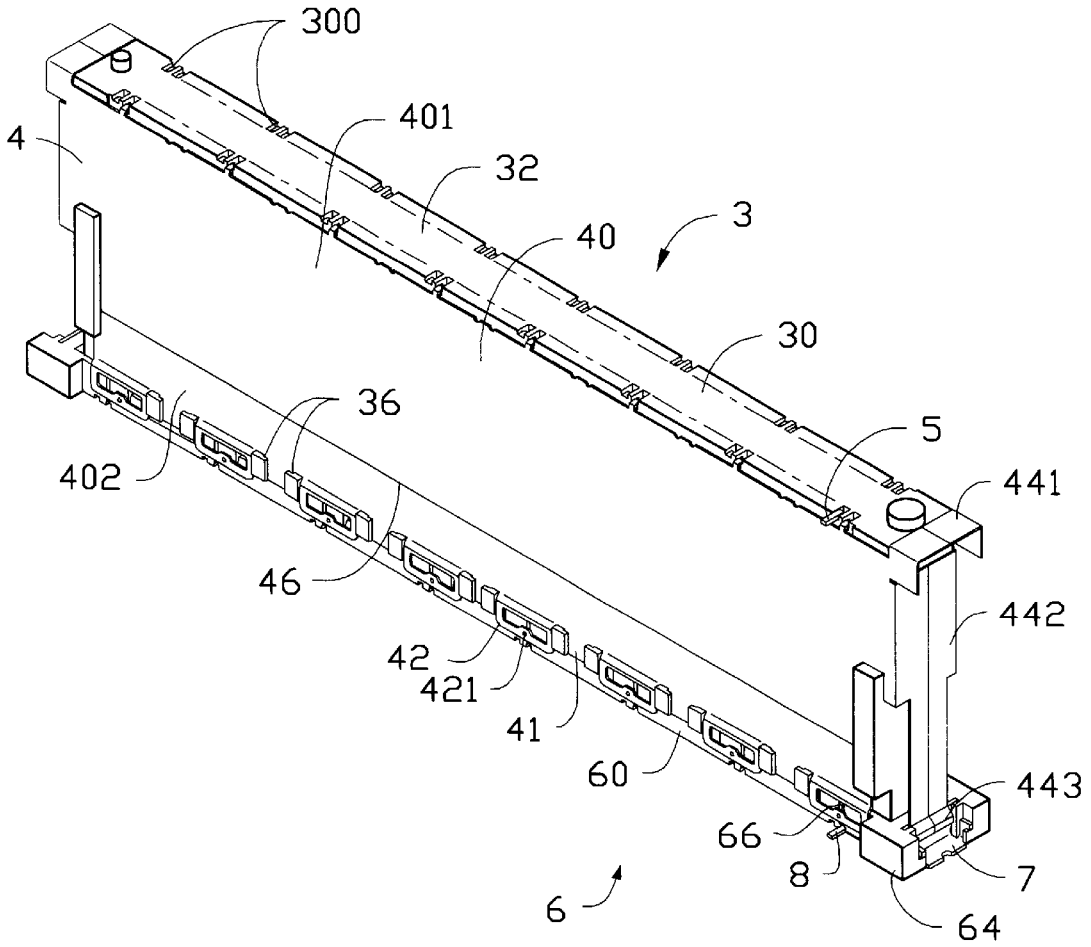
FIG. 4 is a perspective, assembled view of the receptacle and plug connectors.
Figure 5:
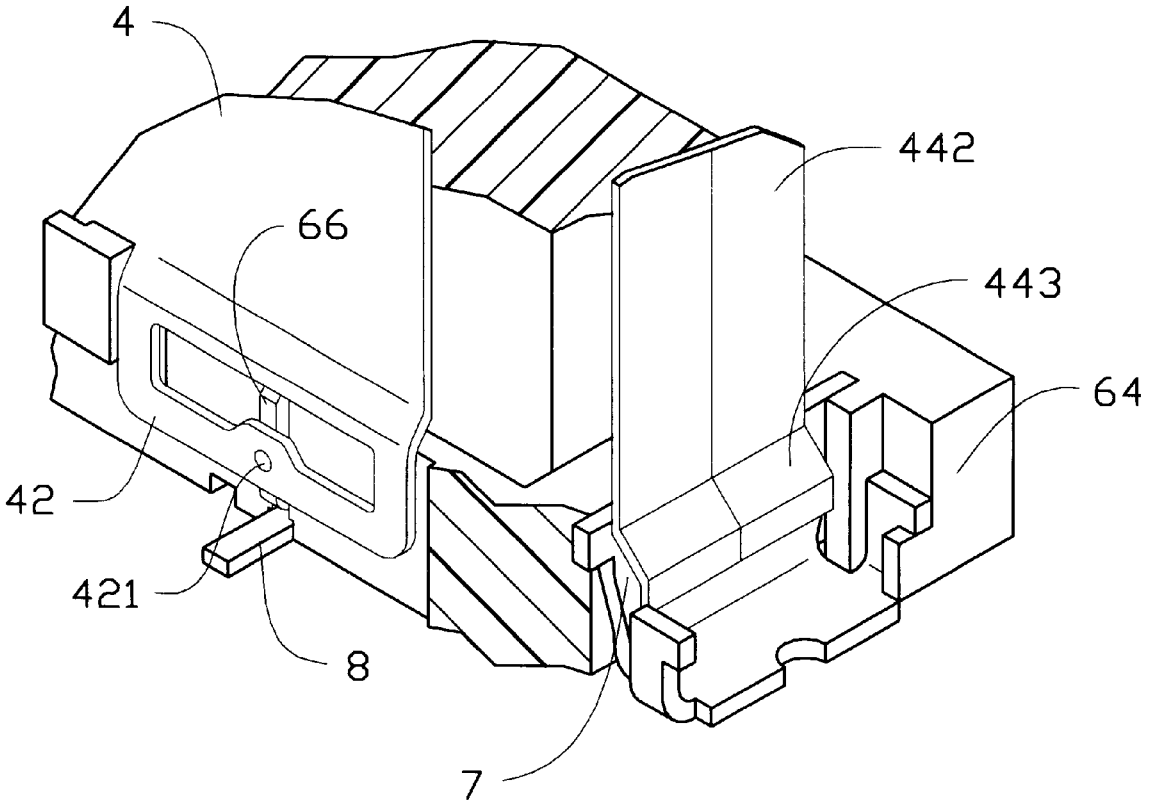
FIG. 5 is a perspective, partially cut-away view of a right, lower corner of the assembled receptacle and plug connectors showing the detail of the connection of the shields of the receptacle connector with an auxiliary contact and a solder pad of the plug connector.

Referring to FIGS. 4 and 5, when the plug and receptacle connectors 3, 6 are assembled, the beads 421 extend into the corresponding auxiliary contact passageways 65 to connect with the corresponding auxiliary contacts 66, and the engaging feet 443 of the legs 442 of the shields 4 of the receptacle connector 3 engage with the solder pads 7 of the plug connector 6.

In the present invention, the solder pads 441 of the receptacle connector 3 are integrally formed with the shields 4; thus, the present invention can reduce the number of components constituting the receptacle connector 3 thereby reducing the manufacturing cost thereof. Furthermore, the side walls 34 of the housing 30 of the receptacle connector 3 are covered by the legs 442 of the shields 4; thus, the connector assembly in accordance with the present invention has a better protection from EMI/RFI than the conventional connector assembly. The lower part 402 is bent to extend in an orientation toward the housing 30 whereby when the connector assembly is assembled the beads 421 can be ensured to properly extend into the auxiliary contact passageways 65 of the plug connector 6 to contact with the auxiliary contacts 66 therein. Finally and most significantly, in addition to the conventional connection achieved by the beads 421 and the auxiliary contacts 66 of the present invention, noise received by the plug connector 6 is transmitted to the grounding circuit of the mother board via the connection between the solder pads 7 and the engaging feet 443 of the legs 442 of the shields 4, whereby a reliable transmission of noise received by the plug connector 6 to ground is ensured.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An electrical connector assembly, comprising:

a receptacle connector, comprising:

a first dielectric housing having a top face for proximity to a mother board, a bottom face opposite the top face, a front and a rear face and two lateral walls between the top and bottom faces, a channel exposed to the bottom face and a number of first contact passageways beside the channel and defined from the top face to the bottom face;

a pair of metal shields fixedly mounted to the front and rear faces of the housing, each shield integrally formed with two lateral sections and a body portion therebetween, each lateral section defining a first solder pad flush with the top face of the first housing and a leg covering a corresponding lateral wall of the first housing; and a number of first contacts fixedly received in the first contact passageways; and a plug connector for connection to a daughter board, comprising:

a second dielectric housing having an outer wall and a ridge in the outer wall, said ridge extending into the channel of the receptacle connector and defining a number of second contact passageways in a front and rear face thereof, respectively;

a number of second contacts fixedly received in the second contact passageways and electrically connecting with the first contacts; and two second solder pads fixed to lateral ends of the second housing and engaging with the legs of the shields of the receptacle connector;

said body portion of each shield being formed with a bent line dividing the body portion in to an upper and lower part extending in different orientation, wherein the lower part extends toward the second dielectric housing of the plug connector.

2. The assembly in accordance with claim 1, wherein the bent line is formed parallel to an upper and lower edge of the shield and wherein the upper part extends parallel to first dielectric housing.

3. The assembly in accordance with claim 1, wherein the outer wall of the second housing defines a number of auxiliary contact passageways receiving a corresponding number of auxiliary contacts therein, the auxiliary contacts electrically connecting with some of the second contacts of the plug connector and the metal shields of the receptacle connector.

4. The assembly in accordance with claim 3, wherein the auxiliary contacts electrically connect with beads formed on lugs on a lower edge of each of the shields, said beads protruding from the lugs toward the first housing.

5. The assembly in accordance with claim 4, wherein the bent line is formed to be parallel to the lower edge of the shield.

6. The assembly in accordance with claim 1, wherein each leg of each shield is formed with an engaging foot at a bottom end thereof, said engaging feet projecting away from the lateral walls of the housing and connecting with the second solder pads of the plug connector.

7. The assembly in accordance with claim 1, wherein the first solder pads are located beside the lateral walls of the first housing.

8. The assembly in accordance with claim 1, wherein the first solder pads and the legs of each of the shields are perpendicular to the body portion thereof.

9. An electrical connector, comprising:

a rectangular housing defining a top face for connection to a printed circuit board, a bottom face for connection to a mated connector, a front and rear face and two lateral walls between the top and bottom faces, a channel exposed to the bottom face and a number of contact passageways beside the channel and defined from the bottom face to the top face;

a number of contacts fixedly received in the contact passageways; and a pair of metal shields mounted to the front and rear faces of the housing, respectively, each shield integrally formed with a rectangular body portion and two lateral sections, each lateral section formed with an upper solder pad bent to be substantially flush with and beside the top face of the housing, and a leg bent to cover a corresponding lateral wall of the housing, said rectangular body portion formed with a bent line between and parallel to an upper and lower edge of the body portion, said bent line causing the lower edge to extend toward the housing.

10. The electrical connector in accordance with claim 9, wherein the upper edge of the body portion of each of the shields defines a number of fingers extending into some of the contact passageways to connect with some of the contacts.

11. The electrical connector in accordance with claim 10, wherein the lower edge of the body portion of each of the shields forms a number of beads projecting toward the housing.

12. The electrical connector in accordance with claim 11, wherein the housing is formed with a number of mounting blocks on the front and rear faces thereof near the bottom face, each shield is formed with a number of alternating engaging tabs and lugs, each engaging tab being interferentially fitted between two corresponding mounting blocks, said beads being formed on said lugs.

13. The electrical connector in accordance with claim 9, wherein each lateral wall of the housing has a depression in a front face and a rear face thereof to define a seat therebelow, and each shield defines two recesses between the lateral sections and the body portion, each recess fittingly receiving a corresponding seat.

14. A combination of a mother board, a receptacle connector, a plug connector and a daughter board, comprising:

a mother board comprising a grounding circuit;

a receptacle connector mounted to the mother board, comprising:

a first dielectric rectangular housing having a top face connected to the mother board, a bottom face opposite the top face, a front and rear face and two lateral walls between the bottom and top faces, a channel in the bottom face and a number of first contact passageways beside the channel and defined from the bottom face to the top face;

a number of first contacts fixedly received in the first contact passageways, each first contact having a tail portion soldered to the mother board; and a pair of metal shields fixed to the front and rear faces of the first housing, each metal shield integrally formed with a pair of lateral sections and a body portion therebetween, each lateral section having an upper solder pad soldered to the grounding circuit of the mother board and a leg covering a corresponding lateral wall of the first housing;

a daughter board comprising a grounding circuit; and a plug connector, comprising:

a second rectangular housing defining an outer wall and a ridge within the outer wall, and extending into the channel of the first housing and defining a number of second contact passageways;

a number of second contacts received in the second contact passageways and electrically connected with the corresponding first contacts, each second contact having a tail portion soldered to the daughter board; and a pair of solder pads fixed to the second housing, soldered to the grounding circuit of the daughter board and electrically connected with the legs of the shields, respectively;

said body portion of each shield being formed with a bent line causing a bottom edge thereof to extend toward the second housing to electrically engage with some of the second contacts.

15. A connector for use with a board, comprising:

a dielectric housing having a top face and a bottom face opposite the top face, a front and a rear face and two lateral walls between the top and the bottom faces;

at least a metal shield including a body portion and mounting to one of said front and rear faces; and said metal shield integrally including at least a solder pad flush with the top face of the housing for mounting to said board, wherein said solder pad extends laterally beyond the corresponding lateral wall of the housing.

16. The connector as described in claim 15, wherein the shield further includes a leg perpendicular to the solder pad and covering the corresponding lateral wall.

17. An arrangement of grounding two mated connectors respectively mounted on two opposite boards, comprising:

a first connector being higher than a second connector;

said first connector including a first housing with at least one shield covering at least one of front and rear faces, said shield further defining at least one leg extending downward along a lateral wall of the first housing, said first connector mounted on a first board; and the second connector mounted to a second board and including at least one solder pad electrically connected to grounding circuits on the second board; wherein the leg of the shield of the first connector substantially engages with the solder pad of the second connector for efficient grounding.

18. The arrangement as described in claim 17, wherein the shield further includes a mounting pad electrically connected to grounding circuits on the first board.

* * * * *